US009765587B2

(12) United States Patent
Boulanger et al.

(10) Patent No.: US 9,765,587 B2
(45) **Date of Patent: *Sep. 19, 2017**

(54) RISER GAS HANDLING SYSTEM

(71) Applicant: Cameron International Corporation, Houston, TX (US)

(72) Inventors: Bruce A. Boulanger, Houston, TX (US); Terry Jason Smith, Houston, TX (US); David L. Gilmore, Baytown, TX (US); Babak Bob Arefi, Spring, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/134,207

(22) Filed: Apr. 20, 2016

(65) Prior Publication Data

US 2016/0230492 A1 Aug. 11, 2016

Related U.S. Application Data

(63) Continuation-in-part of application No. 13/893,190, filed on May 13, 2013.

(60) Provisional application No. 61/801,884, filed on Mar. 15, 2013.

(51) Int. Cl.

| | |
|---|---|
| ***E21B 33/064*** | (2006.01) |
| ***E21B 33/035*** | (2006.01) |
| ***E21B 21/08*** | (2006.01) |
| ***E21B 33/038*** | (2006.01) |
| ***E21B 33/08*** | (2006.01) |

(52) U.S. Cl.

CPC ..... *E21B 33/035* (2013.01); *E21B 21/08* (2013.01); *E21B 33/038* (2013.01); *E21B 33/085* (2013.01)

(58) Field of Classification Search

CPC ..... E21B 43/12; E21B 33/064; E21B 33/038; E21B 34/00; E21B 21/10; E21B 33/06; E21B 41/0007; E21B 21/106; E21B 33/03; E21B 43/00; E21B 17/06; E21B 17/08; E21B 17/085

USPC ..... 166/344, 347, 363, 364, 368, 373, 86.1

See application file for complete search history.

(56) References Cited

U.S. PATENT DOCUMENTS 4,444,401 A * 4/1984 Roche ..... E21B 21/001 166/363
4,668,126 A * 5/1987 Burton ..... E21B 19/002 166/341
4,828,024 A * 5/1989 Roche ..... E21B 21/001 137/869

(Continued)

*Primary Examiner* — Matthew R Buck
*Assistant Examiner* — Edwin Toledo-Duran
(74) *Attorney, Agent, or Firm* — Fletcher Yoder, P.C.

(57) ABSTRACT

An integrated assembly for a mineral extraction system includes an annular blow out preventer (BOP) portion that includes a BOP body coupled to a first portion of an one-piece body, where the annular BOP portion is configured to seal an outer drill string of the mineral extraction system, a diverter portion formed at least partially by a second portion of the one-piece body, where the diverter portion comprises one or more openings, and a rotating control unit (RCU) assembly portion comprising a third portion of the one-piece body coupled to a rotation enabled portion, where the RCU assembly portion is configured to divert drilling fluid through the one or more openings of the diverter portion.

21 Claims, 13 Drawing Sheets

(56) References Cited

U.S. PATENT DOCUMENTS 4,832,126 A * 5/1989 Roche ..... E21B 21/001 137/114
5,279,365 A * 1/1994 Yenulis ..... E21B 34/16 166/84.3
5,314,024 A * 5/1994 Rodgers ..... F16L 27/06 166/347
6,352,114 B1 * 3/2002 Toalson ..... E21B 17/01 166/339
6,474,422 B2 * 11/2002 Schubert ..... E21B 21/08 175/25
6,520,262 B2 * 2/2003 Barnett ..... E21B 33/076 166/339
7,658,228 B2 * 2/2010 Moksvold ..... E21B 17/01 166/345
7,866,399 B2 * 1/2011 Kozicz ..... E21B 17/01 166/344
7,997,345 B2 * 8/2011 Hannegan ..... E21B 33/085 166/345
8,033,335 B2 * 10/2011 Orbell ..... E21B 17/085 166/268
8,176,985 B2 * 5/2012 Humphreys ..... E21B 19/002 166/344
8,459,361 B2 * 6/2013 Leuchtenberg ..... E21B 17/07 166/344
2001/0040052 A1 * 11/2001 Bourgoyne ..... E21B 21/001 175/7
2006/0191716 A1 * 8/2006 Humphreys ..... E21B 19/002 175/5
2007/0095540 A1 * 5/2007 Kozicz ..... E21B 17/01 166/358
2008/0251257 A1 * 10/2008 Leuchtenberg ..... E21B 17/07 166/355
2010/0025044 A1 * 2/2010 McKay ..... E21B 33/076 166/359
2011/0061854 A1 * 3/2011 Davies ..... E21B 33/062 166/95.1
2012/0255783 A1 * 10/2012 Curtis ..... E21B 33/085 175/57
2014/0083711 A1 * 3/2014 Springett ..... E21B 17/01 166/345
2014/0209316 A1 * 7/2014 Tindle ..... E21B 33/035 166/345

* cited by examiner

RISER GAS HANDLING SYSTEM

CROSS-REFERENCE TO RELATED APPLICATION

This Application is a continuation-in-part of U.S. patent application Ser. No. 13/893,190, entitled "Riser Gas Handling System," filed May 13, 2013, which claims priority and benefit to U.S. Provisional Patent Application No. 61/801,884, entitled "Riser Gas Handling System", filed Mar. 15, 2013, which are hereby incorporated by reference in their entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. According, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located offshore depending on the location of a desired resource. These systems enable drilling and/or extraction operations.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
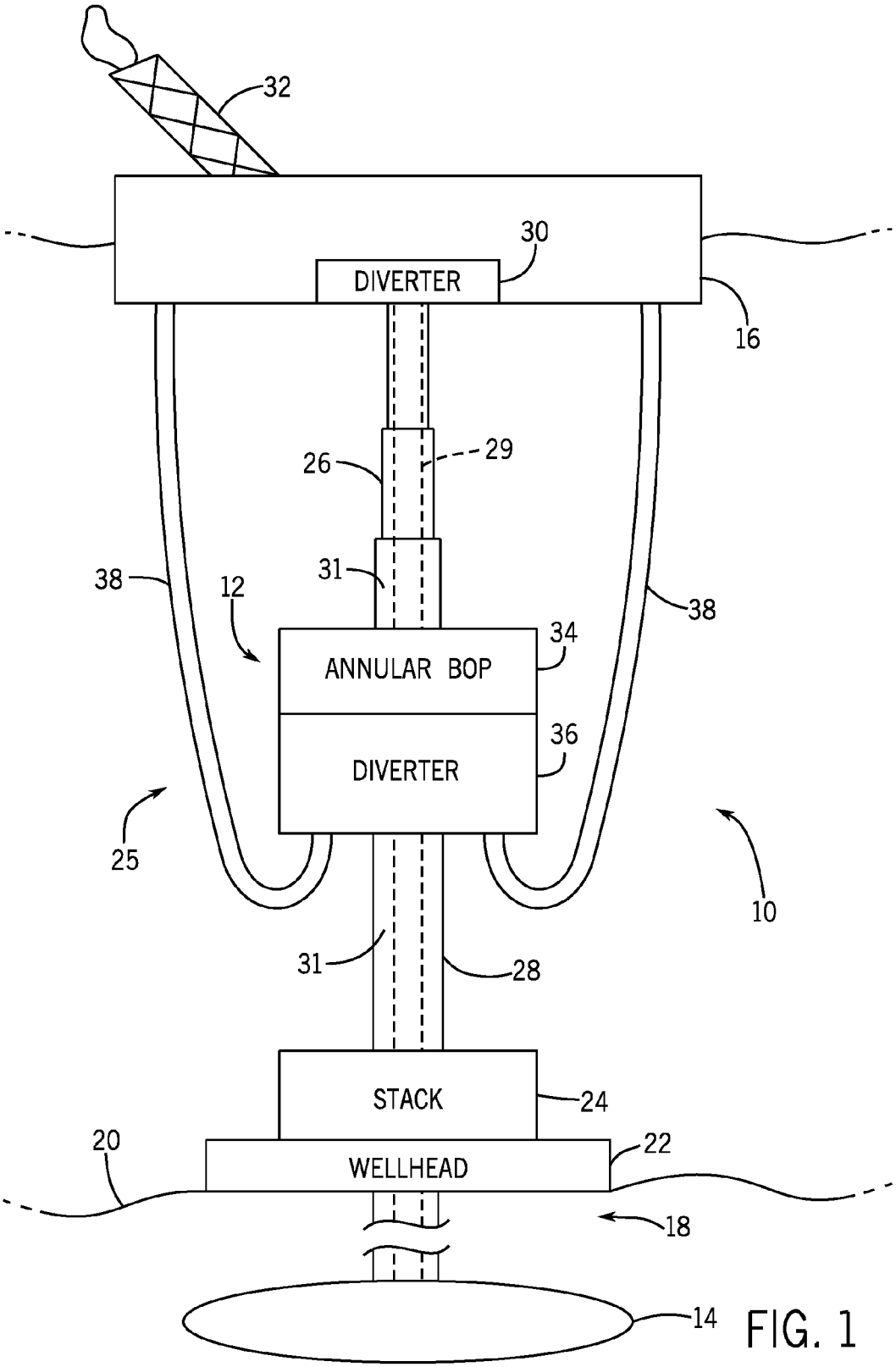
FIG. 1 a schematic of a mineral extraction system with a riser gas handler system, in accordance with an aspect of the present disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

As discussed in detail below with reference to FIGS. 1-9, the disclosed embodiments include a modular riser gas handling system capable of changing configuration depending on the type of drilling operation. Specifically, the modular riser gas handling system may include separable assemblies (e.g., rotating control unit, annular BOP, diverter) capable of coupling and decoupling to adjust for different drilling operations. In operation, the riser gas handling system blocks the flow materials (e.g., mud, cuttings, natural resources) to the drill floor of a platform or ship by diverting the materials to another location. However, different types of drilling operations may involve different methods with different equipments needs. For example, in managed pressure drilling operations the riser gas handling system may include a rotating control unit assembly, an annular BOP assembly, and a diverter assembly. However, in another drilling operation a rotating control unit may be unnecessary. Accordingly, the modularity of the riser gas handling system enables the selection and exclusion of different pieces of equipment depending on the drilling operation. Moreover, the modularity of the riser gas handling system 12 facilitates storage, movement, and assembly on site.

As discussed in detail below with reference to FIGS. 10-16, the disclosed embodiments include an integrated riser gas handling system having shared structure. For example, the integrated riser gas handling system may include an annular BOP portion, a diverter portion, and/or a rotating control unit assembly portion that may include a shared component. In accordance with the disclosed embodiments, the integrated riser gas handling system may include an integrated member that may extend into the annular BOP portion and form at least a portion of the diverter portion and the rotating control unit assembly portion. Accordingly, an overall height of the riser gas handling system may be reduced because separate coupling features (e.g., flange connections) may not be included in the riser gas handling system. Additionally, including the integrated member in the riser gas handling system may reduce a weight of the riser gas handling system, which may facilitate assembly of the mineral extraction system. Further, the rotating control unit assembly portion may include a removable bearing assembly that may enable the riser gas handling system to accommodate pressure regulated drilling (e.g., managed pressure drilling) when installed, and traditional drilling techniques when removed.

FIG. 1 is a schematic of a mineral extraction system 10 with a riser gas handling system 12. The mineral extraction system 10 is used to extract oil, natural gas, and other natural resources from a subsea mineral reservoir 14. As illustrated, a ship or platform 16 positions and supports the mineral extraction system 10 over a mineral reservoir 14 enabling the mineral extraction system 10 to drill a well 18 through the sea floor 20. The mineral extraction system 10 includes a wellhead 22 to that forms a structural and pressure containing interface between the well 18 and the sea floor 20. Attached to the wellhead 22 is a stack 24. The stack 24 may include among other items blowout preventers (BOPS) that enable pressure control during drilling operations. In order to drill the well 18, an outer drill string 25 couples the ship or platform to the wellhead 22. The outer drill string 25 may include a telescoping joint 26 and a riser 28. The telescoping joint 26 enables the mineral extraction system 10 to flexibly respond to up and down movement of the ship or platform 16 on an unstable sea surface.

In order to drill the well 18, an inner drill string 29 (i.e., a drill and drill pipe) passes through the telescoping joint 26 and the riser 28 to the sea floor 20. During drilling operations the inner drill string 29 drills through the sea floor as drilling mud is pumped through the inner drill string 29 to force the cuttings out of the well 18 and back up the outer drill string 25 (i.e., in a space 31 between the outer drill string 25 and the inner drill string 29) to the drill ship or platform 16. When the well 18 reaches the mineral reservoir 14 natural resources (e.g., natural gas and oil) start flowing through the wellhead 22, the riser 28, and the telescoping joint 26 to the ship or platform 16. As natural gas reaches the ship 16, a diverter system 30 diverts the mud, cuttings, and natural resources for separation. Once separated, natural gas may be sent to a flare 32 to be burned. However, in certain circumstances it may be desirable to divert the mud, cuttings, and natural resources away from a ship's drill floor. Accordingly, the mineral extraction system 10 includes a riser gas handling system 12 that enables diversion of mud, cuttings, and natural resources before they reach a ship's drill floor.

The riser gas handling system 12 may include an annular BOP assembly 34 and a diverter assembly 36. In some embodiments, the riser gas handler 12 may be a modular system wherein the annular BOP assembly 34 and the diverter assembly 36 are separable components capable of on-site assembly. The riser gas handling system 12 uses the annular BOP assembly 34 and the diverter assembly 36 to stop and divert the flow of natural resources from the well 18, which would normally pass through the outer drill string 25 that couples between the ship or platform 16 and the wellhead 22. Specifically, when the annular BOP assembly 34 closes it prevents natural resources from continuing through the outer drill string 25 to the ship or platform 16. The diverter assembly 36 may then divert the flow of natural resources through drape hoses 38 to the ship or platform 16 or prevent all flow of natural resources out of the well 18.

In operation, the riser gas handling system 12 may be used for different reasons and in different circumstances. For example, during drilling operations it may be desirable to temporarily block the flow of all natural resources from the well 18. In another situation, it may be desirable to divert the flow of natural resources from entering the ship or platform 16 near or at a drill floor. In still another situation, it may be desirable to divert natural resources in order to conduct maintenance on mineral extraction equipment above the annular BOP assembly 34. Maintenance may include replacement or repair of the telescoping joint 26, among other pieces of equipment. The riser gas handling system 12 may also reduce maintenance and increase the durability of the telescoping joint 26. Specifically, by blocking the flow of natural resources through the telescoping joint 26 the riser gas handling system 12 may increase the longevity of seals (i.e., packers) within the telescoping joint 26.

Figure 2:
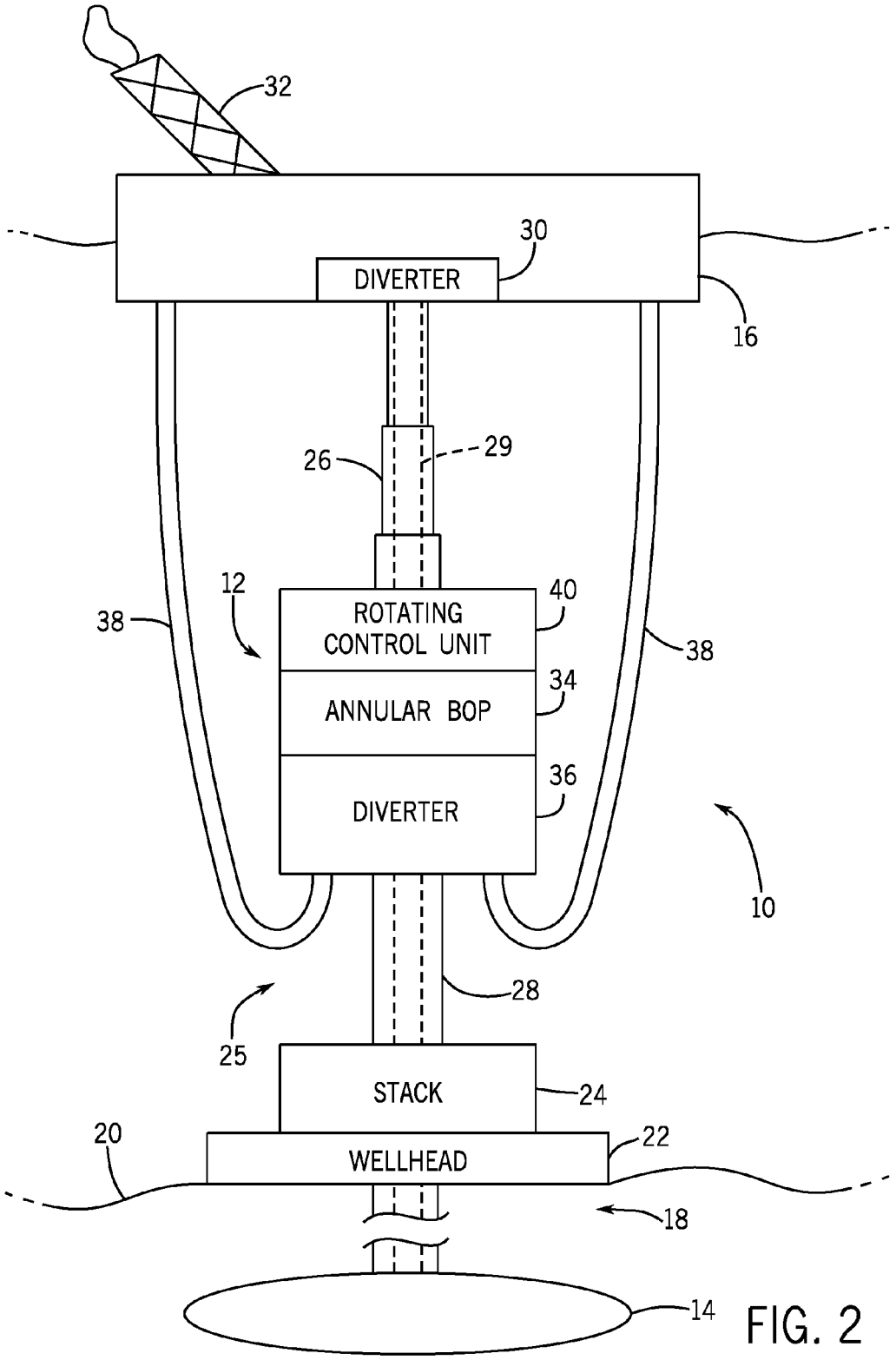
FIG. 2 a schematic of a mineral extraction system with a riser gas handler system, in accordance with an aspect of the present disclosure.

FIG. 2 is a schematic of another mineral extraction system 10 with a riser gas handling system 12. The mineral extraction system 10 of FIG. 2 may use managed pressure drilling to drill through a sea floor made of softer materials (i.e., materials other than only hard rock). Managed pressure drilling regulates the pressure and flow of mud flowing through the inner drill string to ensure that the mud flow into the well 18 does not over pressurize the well 18 (i.e., expand the well 18) or allow the well to collapse under its own weight. The ability to manage the drill mud pressure therefore enables drilling of mineral reservoirs 14 in locations with softer sea beds.

The riser gas handling system 12 of FIG. 2 is a modular system for managed pressure drilling. As illustrated, the riser gas handling system 12 includes three components the annular BOP assembly 34, the diverter assembly 36, and the rotating control unit assembly 40. In operation, the rotating control unit assembly 40 forms a seal between the inner drill string 29 and the outer drill string 25 (e.g., the telescoping joint 26), which prevents mud, cutting, and natural resources from flowing through the telescoping joint 26 and into the drill floor of a platform or ship 16. The rotating control unit assembly 40 therefore blocks CO2, H2S, corrosive mud, shallow gas, and unexpected surges of material flowing through the outer drill string 25 from entering the drill floor. Instead, the mud, cuttings, and natural resources return to the ship or platform 16 through the drape hoses 38 coupled to the diverter assembly 36. As explained above, the modularity of the riser gas handling system 12 enables maintenance on mineral extraction equipment above the annular BOP assembly 34. Maintenance may include replacement or repair of the telescoping joint 26, the rotating control unit assembly 40, among other pieces of equipment. Moreover, the modularity of the riser gas handling system 12 facilitates storage, movement, assembly on site, and as will be explained in further detail below enables different configurations depending on the needs of a particular drilling operation.

Figure 3:
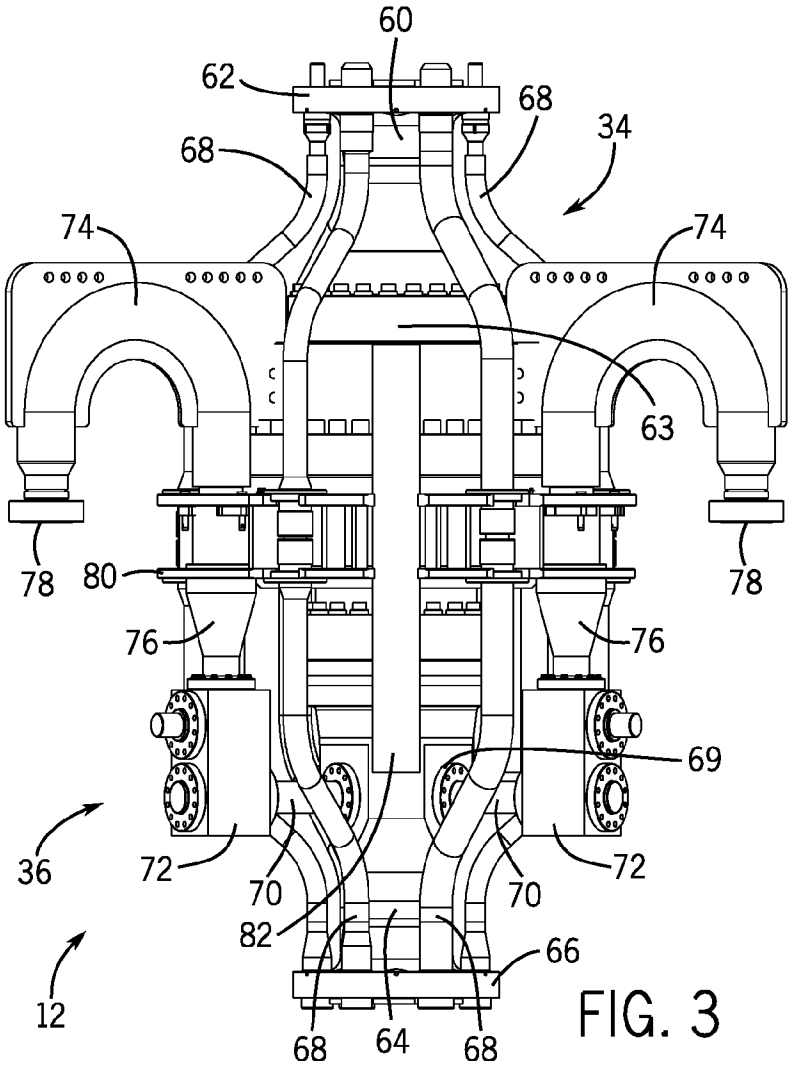
FIG. 3 is a front view of a riser gas handler system, in accordance with an aspect of the present disclosure.

FIG. 3 is a front view of a riser gas handling system 12 in one configuration. In the illustrated embodiment, the riser gas handling system 12 includes an annular BOP assembly 34 and a diverter assembly 36 combined together. However, in managed pressure drilling operations, the riser gas handling system 12 may change configurations by coupling the annular BOP assembly 34 and the diverter assembly 36 to a rotating control unit assembly 40. The modularity of the riser gas handling system 12 enables on-site modification to facilitate different kinds of drilling operations.

As illustrated, the riser gas handling system 12 includes an upper BOP spool connector 60 with a connector flange 62. The upper BOP spool adapter connector 60 enables the annular BOP assembly 34 with the annular BOP 63 to couple to other components in the mineral extraction system 10. For example, during managed pressure drilling operations the upper BOP spool connector 60 enables the annular BOP assembly 34 to couple to a rotating control unit assembly 40. In another situation, the upper BOP spool connector 60 may couple to the telescoping joint 26. On the opposite end of the riser gas handling system 12 is a lower diverter spool connector 64 coupled to the annular BOP 63. The lower diverter spool connector 64 includes a connector flange 66 that enables the lower diverter spool connector 64 to couple to the riser 28, placing the riser gas handling system 12 in the fluid path of mud, cutting, and natural resources flowing through the riser 28 to the platform or ship 16 above. In between the upper spool connector 60 and the lower diverter spool connector 64 are multiple lines or hoses 68. The lines 68 may be hydraulic lines, mud boost lines, control lines, fluid lines, or a combination thereof. The lines 68 on the riser gas handling system 12 enable fluid communication with lines above and below the riser gas handler 12.

In order to divert mud, cuttings, and natural resources from coming through the riser 28, the diverter assembly 36 includes apertures 69 in the lower diverter spool connector 64. The flange spools 70 couple to the apertures 69 and divert materials flowing through the riser 28 towards valves 72. When open the valves 72 divert material to the gooseneck connection 74 through valve connectors 76. As illustrated, the gooseneck connectors 74 form a semi-annular shape with drape connection ports 78. The drape hoses 38 are then able to couple to these ports 78 enabling material to flow to the platform or ship 16. When connected, the drape hoses 38 may move with subsea currents creating torque on the flange spools 70. In some embodiments, the riser gas handler 12 includes gooseneck support bracket(s) 80. The bracket(s) 80 may relieve or block rotational stress on the flange spools 70 increasing the durability of the diverter assembly 36.

In operation, the valves 72 open and close in response to the hydraulics stored in accumulators 82. As explained above, the riser gas handling system 12 may be used for different reasons and in different circumstances. For example, during drilling operations it may be desirable to temporarily block the flow of all natural resources from the well 18. In another situation, it may be desirable to divert the flow of natural resources from entering the ship or platform 16 near or at a drill floor. In still another situation, it may be desirable to divert natural resources in order to conduct maintenance on mineral extraction equipment above the annular BOP assembly 34. Accordingly, the valves 72 may be opened or closed depending on the need to divert materials or to stop the flow of all materials to the ship or platform 16. However, in other embodiments, the diverter system 36 may facilitate the injection of fluids (e.g., mud, chemicals, water) into the outer drill string 25 through one or more of the gooseneck connections 74. In still other embodiments, the diverter assembly 36 may facilitate injection of materials and the extraction of materials through different gooseneck connections 74 and valves 72 simultaneously or by alternating between injection and extraction.

Figure 4:
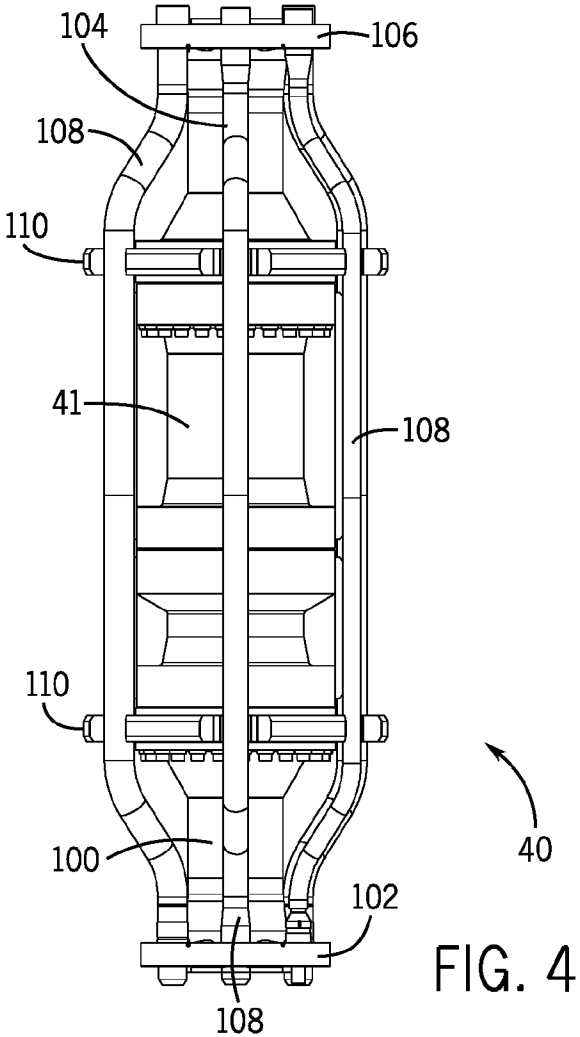
FIG. 4 is a front view of a rotating control unit, in accordance with an aspect of the present disclosure.

FIG. 4 is a front view of a rotating control unit (RCU) assembly 40. As explained above, the modularity of the riser gas handling system 12 enables the attachment and detachment of the RCU assembly 40, depending on the drilling operation. The RCU assembly 40 includes an RCU 41 coupled to a lower RCU spool connector 100. The lower RCU spool connector 100 includes a connecting flange 102 that enables coupling of the RCU assembly 40 to the connecting flange of a BOP spool connector. Opposite the lower RCU spool connector 100 is an upper RCU spool connector 104 with a connector flange 106. The upper RCU spool connector 104 couples to the RCU 41 opposite the lower RCU spool connector 100 and enables coupling to the telescoping joint 26. In between the upper RCU spool connector 104 and the lower RCU spool connector 100 are multiple lines or hoses 108. The lines 108 may be hydraulic lines, mud boost lines, control lines, fluid lines, or a combination thereof. The lines 108 on the RCU assembly 40 enable continued fluid communication with lines above and below the RCU assembly 40. In some embodiments, the RCU assembly 40 may include support clamp connections 110 to provide additional support for the lines 108.

Figure 5:
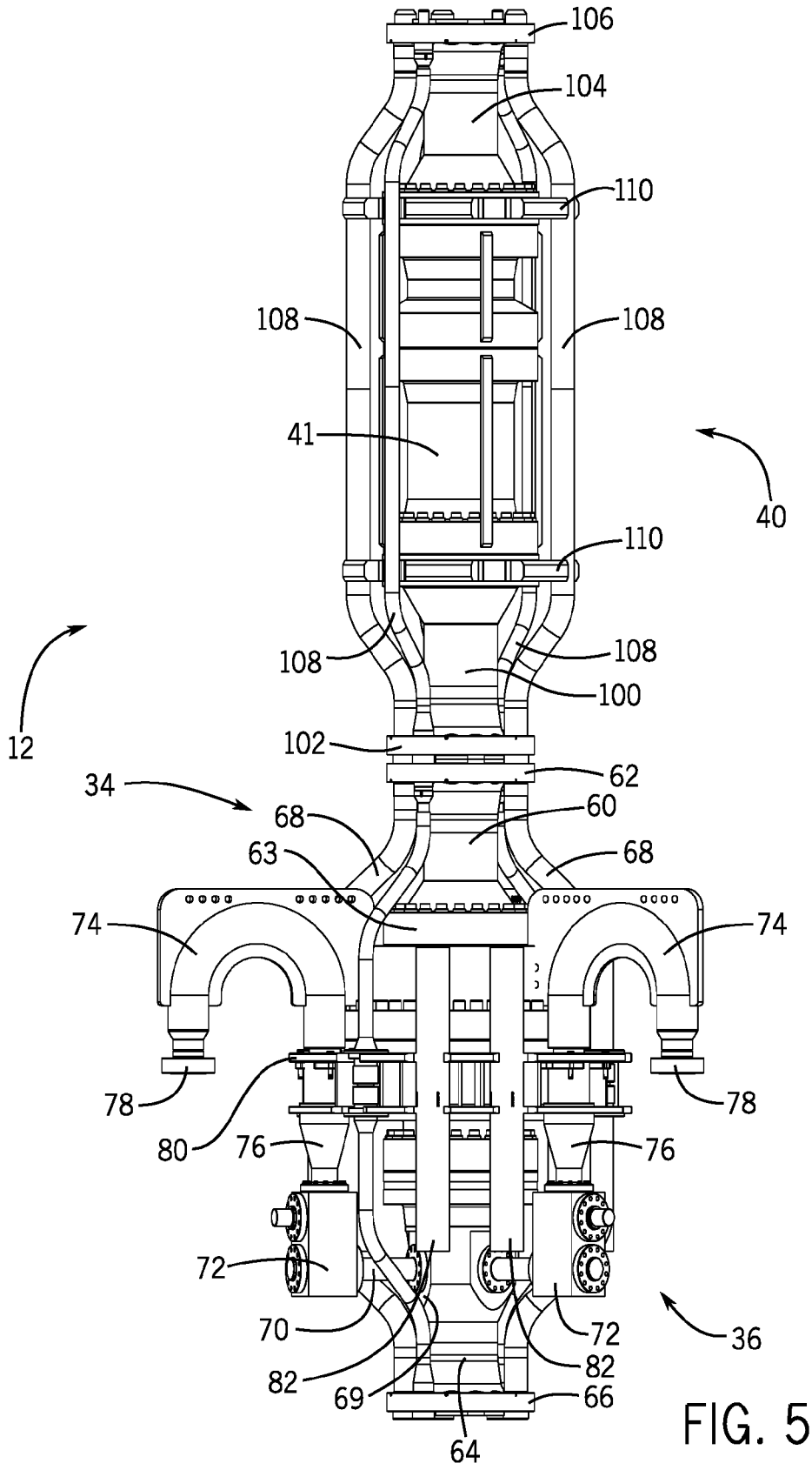
FIG. 5 is a front view of a riser gas handler system, in accordance with an aspect of the present disclosure.

FIG. 5 is a front view of an embodiment of a riser gas handling system 12 including the annular BOP assembly 34, the diverter assembly 36, and the RCU assembly 40. As illustrated, the connector flange 102 of the lower RCU spool connector 100 couples to the connector flange 62 of the upper BOP spool connector 60. Furthermore, the connection of the lower RCU spool connector 100 to the upper BOP spool connector 60, connects the lines 108 to the lines 68 enabling fluid communication between lines above RCU assembly 40 and lines below the diverter assembly 36. The modularity of the riser gas handling system 12 enables the RCU assembly 40 to couple and decouple, which increases the flexibility of the riser gas handling system 12 to operate in different drilling operations.

Figure 6:
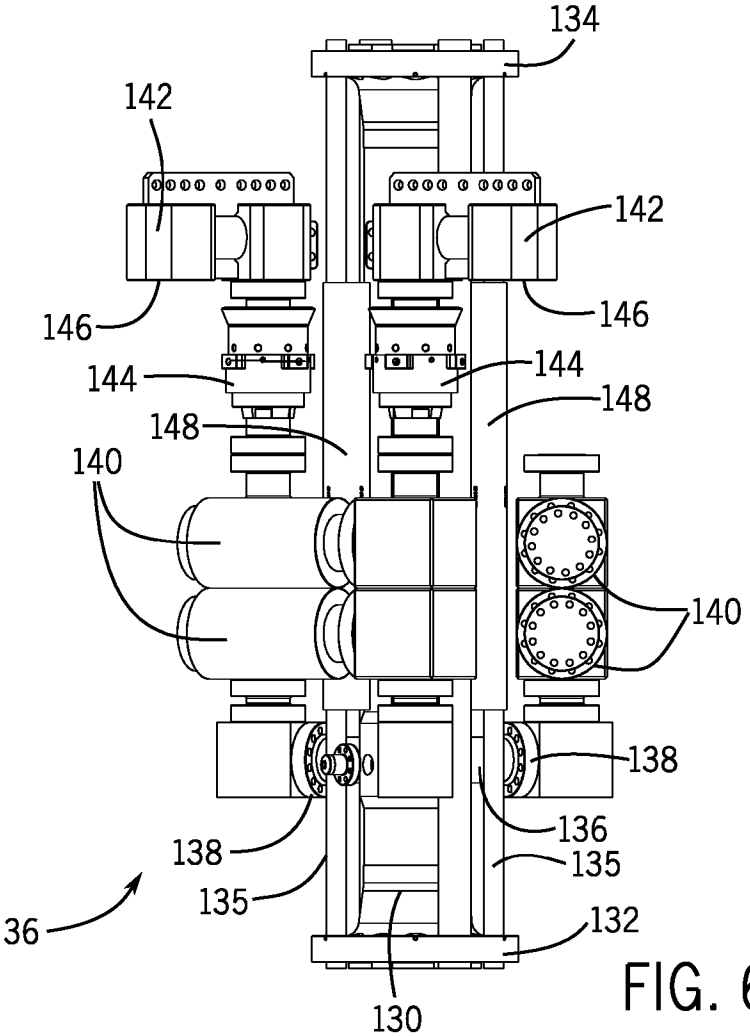
FIG. 6 is a front view of diverter, in accordance with an aspect of the present disclosure.

FIG. 6 is a front view of diverter assembly 36 capable of coupling to an annular BOP assembly 34 in a riser gas handling system 12. The diverter assembly 36 includes a multi-port spool 130 with upper and lower connector flanges 132 and 134. The connector flanges 132 and 134 couple the multi-port spool 130 to neighboring components in the mineral extraction system 10. Specifically, the upper connector flange 134 enables attachment to an annular BOP assembly 34, while the lower connector flange 132 enables attachment to the riser 28. In between the connector flanges 132 and 134 of the multi-port spool 130 are multiple lines or hoses 135. The lines 135 may be hydraulic lines, mud boost lines, control lines, fluid lines, or a combination thereof. The lines 135 on the diverter assembly 36 enable continued fluid communication with lines above and below the diverter assembly 36.

As explained above, the diverter assembly 36 may divert mud, cuttings, and natural resources from coming through the riser 28 through apertures 136. Coupled to the apertures 136 are diverters 138 that enable material to flow out of the multi-port spool 130 to the valves 140. When open the valves 140 divert material to the gooseneck connection 142 through valve connectors 144. As illustrated, the gooseneck connectors 142 form a semi-annular shape with drape connection ports 146. The drape hoses 38 are then able to couple to these ports 146 facilitating material flow to the platform or ship 16.

In operation, the valves 140 open and close in response to the hydraulics stored in accumulators 148. As explained above, the riser gas handling system 12 may be used for different reasons and in different circumstances. For example, during drilling operations it may be desirable to temporarily block the flow of all natural resources from the well 18. In another situation, it may be desirable to divert the flow of natural resources from entering the ship or platform 16 near or at a drill floor. In still another situation, it may be desirable to divert natural resources in order to conduct maintenance on mineral extraction equipment above the annular BOP assembly 34. Accordingly, the valves 140 may be opened or closed depending on the need to divert materials or to stop the flow of all materials to the ship or platform 16.

Figure 7:
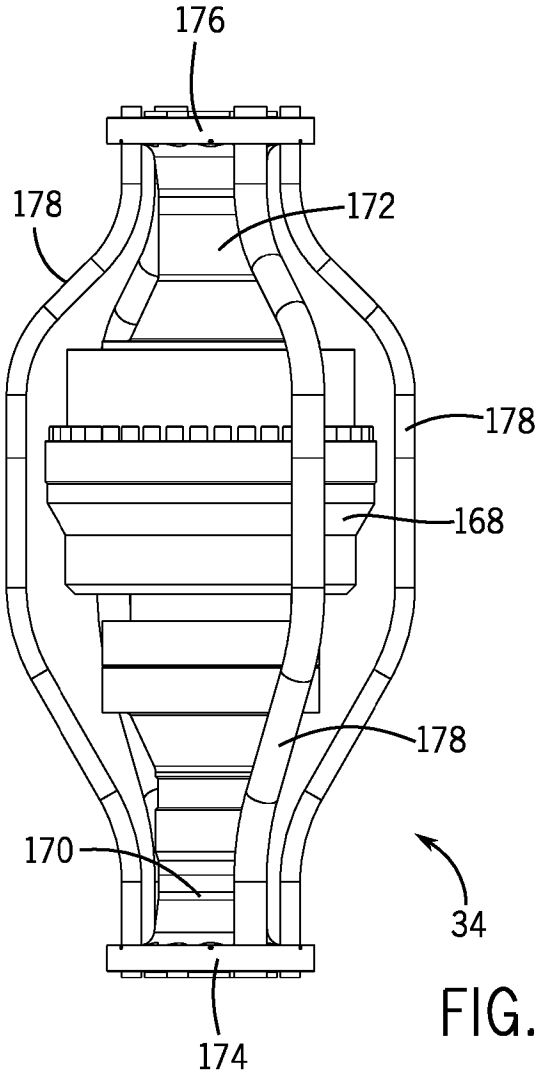
FIG. 7 is a front view of an annular blowout preventer, in accordance with an aspect of the present disclosure.

FIG. 7 is a front view of an annular BOP assembly 34. The annular BOP assembly 34 includes an annular BOP 168 between a lower BOP spool connector 170 and an upper BOP spool connector 172. The lower BOP spool connector 170 includes a connecting flange 174 that enables coupling of the annular BOP assembly 34 to the diverter assembly 36. The annular BOP assembly 34 also includes an upper BOP spool connector 172 with connector flange 176. The connector flange 176 of the upper BOP spool connector 172 enables the annular BOP assembly 34 to couple to the telescoping joint 26, or the rotating control unit assembly 40, among other pieces of equipment. In between the lower BOP spool connector 170 and the upper BOP spool connector 172 are multiple lines or hoses 178. The lines 178 may be hydraulic lines, mud boost lines, control lines, fluid lines, or a combination thereof. The lines 178 on the annular BOP assembly 34 enable continued fluid communication with lines above and below the annular BOP assembly 34.

Figure 8:
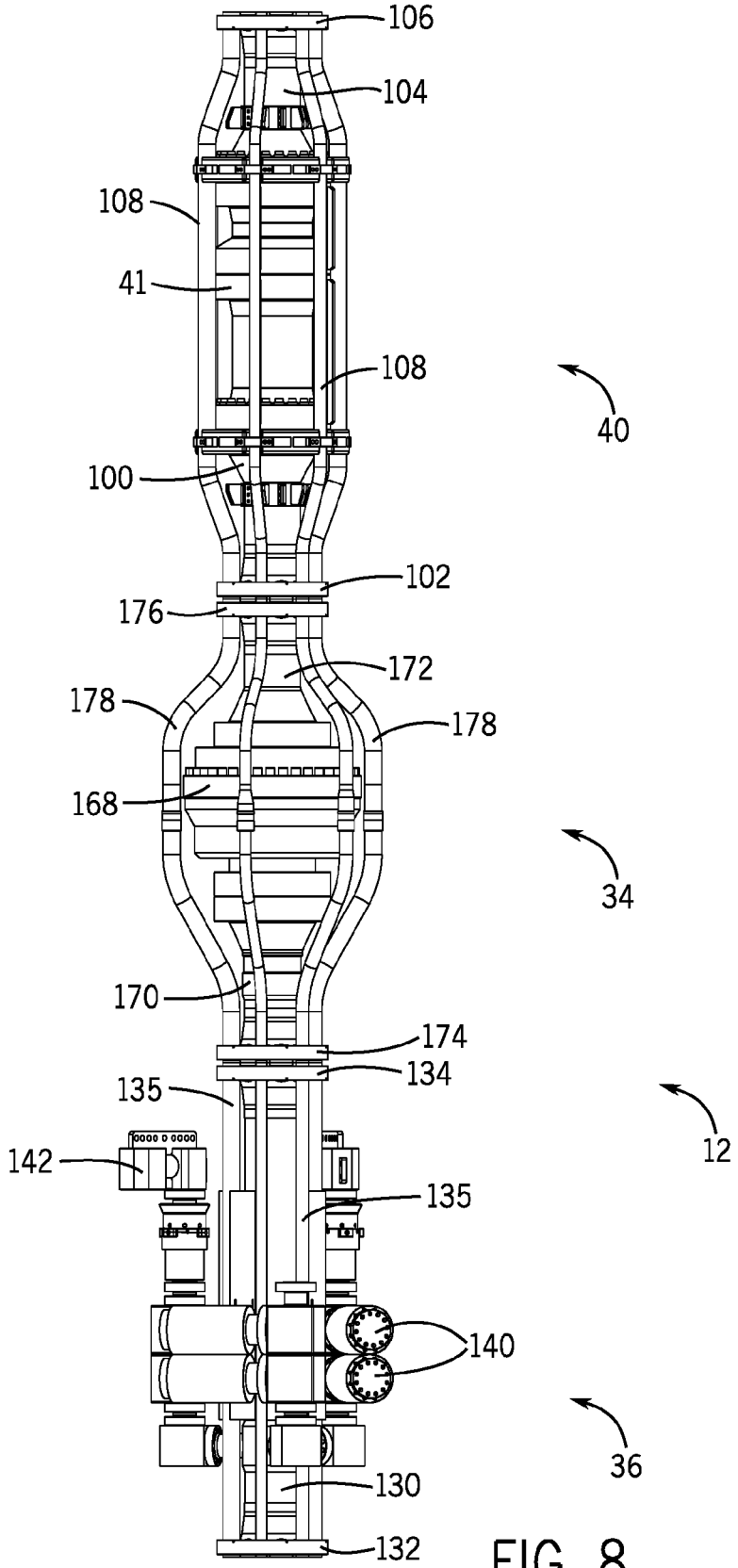
FIG. 8 is a front view of a riser gas handler system, in accordance with an aspect of the present disclosure.

FIG. 8 is a front view of a riser gas handling system 12. In the illustrated configuration, the modular riser gas handling system 12 couples all of the assemblies together (e.g., the diverter assembly 36, the annular BOP assembly 34, and the RCU assembly 40). Specifically, the connection flange 134 of the diverter assembly 36 couples to the connector flange 174 of the annular BOP assembly 34, and the annular BOP connector flange 176 couples to the connector flange 102 of the RCU assembly 40. The connection of the diverter assembly 36, the annular BOP assembly 34, and the RCU assembly 40 enables fluid communication between lines above RCU assembly 40 and lines below the diverter assembly 36. In the illustrated configuration, the riser gas handling system 12 may assist in managed pressure drilling operations. However, the riser gas handling system 12 may have different configurations including a configuration with only the diverter assembly 36 and the annular BOP assembly 34. The modularity of the riser gas handling system 12 enables on-site modification to facilitate different kinds of drilling operations, as well as replacement of different components in the riser gas handling system 12.

Figure 9:
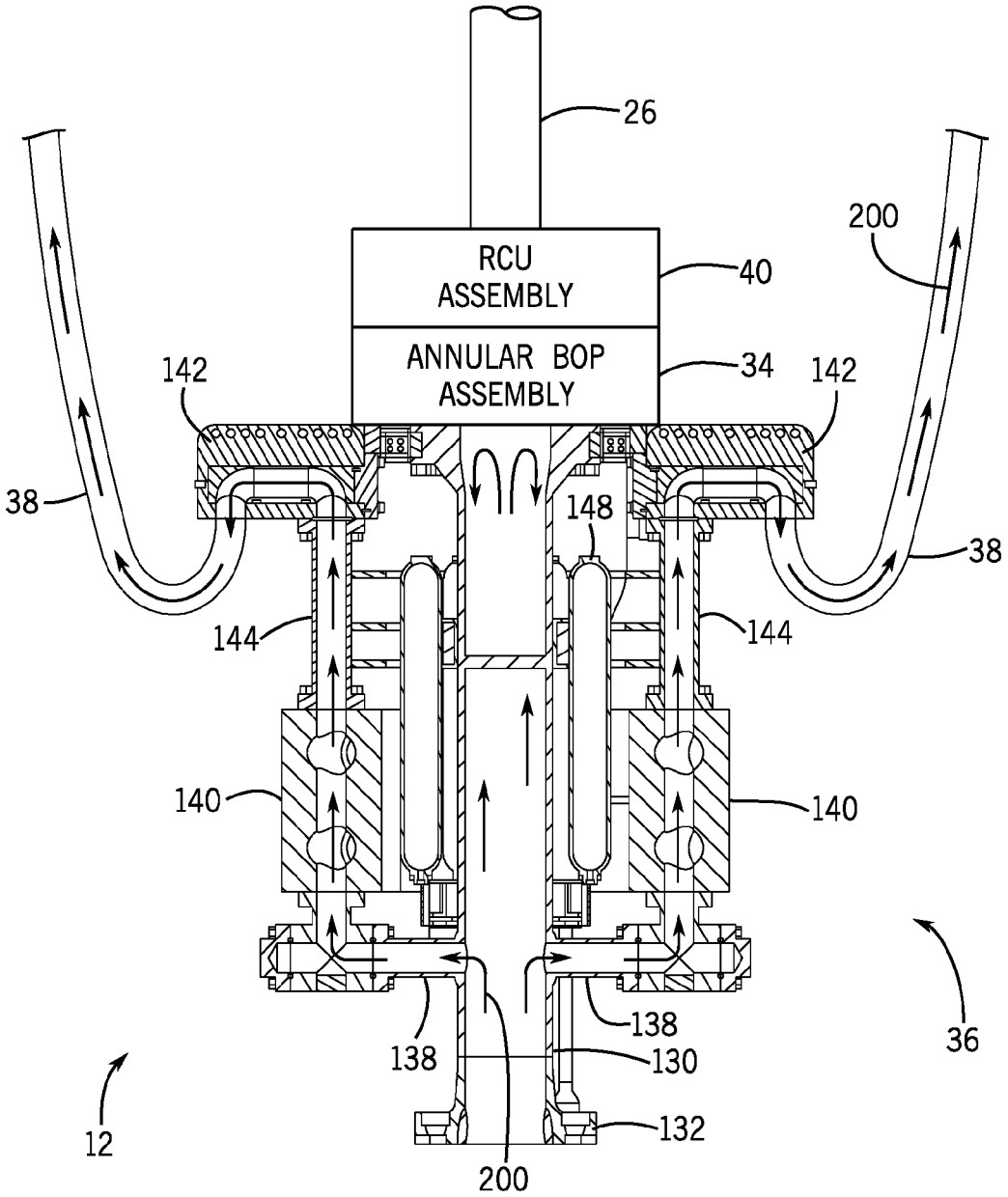
FIG. 9 is a cross-sectional view of a diverter, in accordance with an aspect of the present disclosure.

FIG. 9 is a cross-sectional view of a diverter assembly 36 coupled to the annular BOP assembly 34. As explained above, the riser gas handler assembly 12 may block the flow of material 200 (e.g., mud, cuttings, natural resources) through the outer drill string 25 (i.e., through the telescoping joint 26) with either an annular BOP assembly and/or an RCU assembly 40. When the riser gas handling system 12 blocks the flow material 200 the material 200 may remain within the riser 28 or be redirected through the diverter assembly 36. As illustrated, the valves 140 of the diverter system 36 are open enabling the flow of material 200 through the diverter system 36 to the gooseneck connections 142 where the material 200 enters the drape hoses 38 for deliver to the platform or ship 16. However, in other embodiments, the diverter system 36 may facilitate the injection of fluids (e.g., mud, chemicals, water) into the outer drill string 25 through the gooseneck connections 142. In still other embodiments, the diverter assembly 36 may facilitate injection of fluids and the extraction of the materials 200 through different gooseneck connection 142 and valves 140 simultaneously or by alternating between injection and extraction.

In certain embodiments, components may be integrated with one another (e.g., coupled to one another without a flange connection) to form a single component forged or otherwise formed as one piece. Integrating components into a single component may facilitate assembly of the mineral extraction system 10, reduce a height and/or weight of the mineral extraction system 10, reduce an amount of joints that may allow leakage of drilling fluid from the outer drill string 25, and/or enable the mineral extraction system 10 to perform additional operations (e.g., perform managed pressure drilling and/or conventional drilling techniques). For example, FIG. 10 is a schematic of the mineral extraction system 10 that includes an integrated RCU, diverter, and annular BOP assembly 220 ("the integrated assembly 220").

Figure 10:
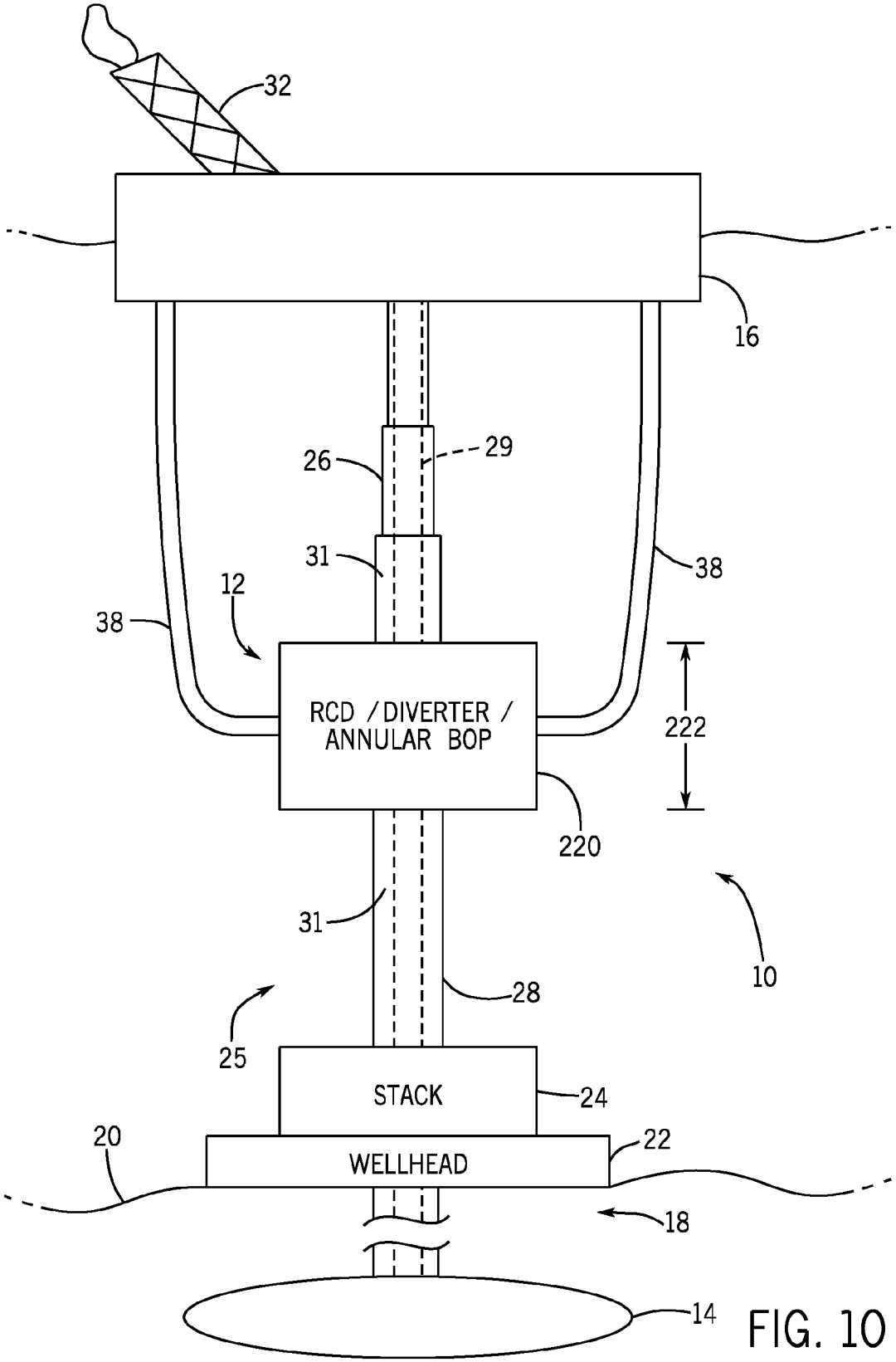
FIG. 10 is a schematic of another embodiment of the mineral extraction system of FIG. 1 having an integrated annular blow out preventer (BOP), diverter, and rotating control device (integrated assembly), in accordance with an aspect of the present disclosure.

As shown in the illustrated embodiment of FIG. 10, the integrated assembly 220 may be disposed in a similar location along the outer drill string 25 as the gas riser handling assembly 12. In some embodiments, the integrated assembly 220 may include a height 222 that is less than a combined height of the RCU assembly 40, the diverter 36, and the annular BOP 34 (e.g., the gas riser handling assembly 12). Accordingly, utilizing the integrated assembly 220 may enable additional components to be included in the mineral extraction system 10 as a result of an increase in space created by the reduced height. Similarly, the integrated assembly 220 may include a weight that is less than a combined weight of the RCU assembly 40, the diverter 36, and the annular BOP 34. For example, the integrated assembly 220 may include at least one common component between (e.g., shared one-piece structure or body) the integrated RCU assembly 40, the diverter 36, and/or the annular BOP 34. In particular, the common component (e.g., one-piece body) may include features of two or more of the components in the integrated assembly 220, such as parts of the diverter 36, internal mounting portions for the RCU assembly 40, and/or internal mounting portions for the annular BOP 34. In some cases, the common component may be lighter than separate components because no flanges or other coupling devices are utilized, thereby reducing a weight of the mineral extraction system 10. Reducing the weight of the mineral extraction system 10 may be desirable during assembly and/or operation. For example, components that include a reduced weight may facilitate movement and/or installation, which may decrease an assembly time of the mineral extraction system 10. Further, reducing a weight of the components may reduce stress applied by such components to the mineral extraction system 10 (e.g., stress on the outer drill string 25 and/or other components of the mineral extraction system 10).

In some cases, utilizing the common component (e.g., one-piece body) may reduce leakage (e.g., eliminate a leak path) of the drilling fluid from the outer drill string 25. For example, the common component may reduce an amount of joints that are utilized to couple separate components (e.g., the annular BOP 34, the diverter 36, and/or the RCU assembly 40) to one another. Such joints may be susceptible to leakage as wear occurs to sealing components that are included in the joints. Accordingly, integrating the gas riser handling assembly may reduce maintenance time to correct leaks that may occur between components of the gas riser handling system.

Additionally, utilizing the integrated assembly 220 may facilitate switching between drilling techniques of the mineral extraction system 10. For example, disposing a bearing assembly in an RCU assembly portion of the integrated assembly 220 may enable the mineral extraction system 10 to perform managed pressure drilling ("MPD") because the bearing assembly may seal the outer drill string, thereby diverting drilling fluids away from the platform 16 and enabling pressure regulation of the well 18. Further, when conventional drilling techniques are desired (e.g., non-MPD), the bearing assembly may be removed and/or disengaged such that the RCU assembly portion of the integrated assembly 220 functions as a passageway from an annular BOP portion of the integrated assembly 220 toward the platform 16.

Figure 11:
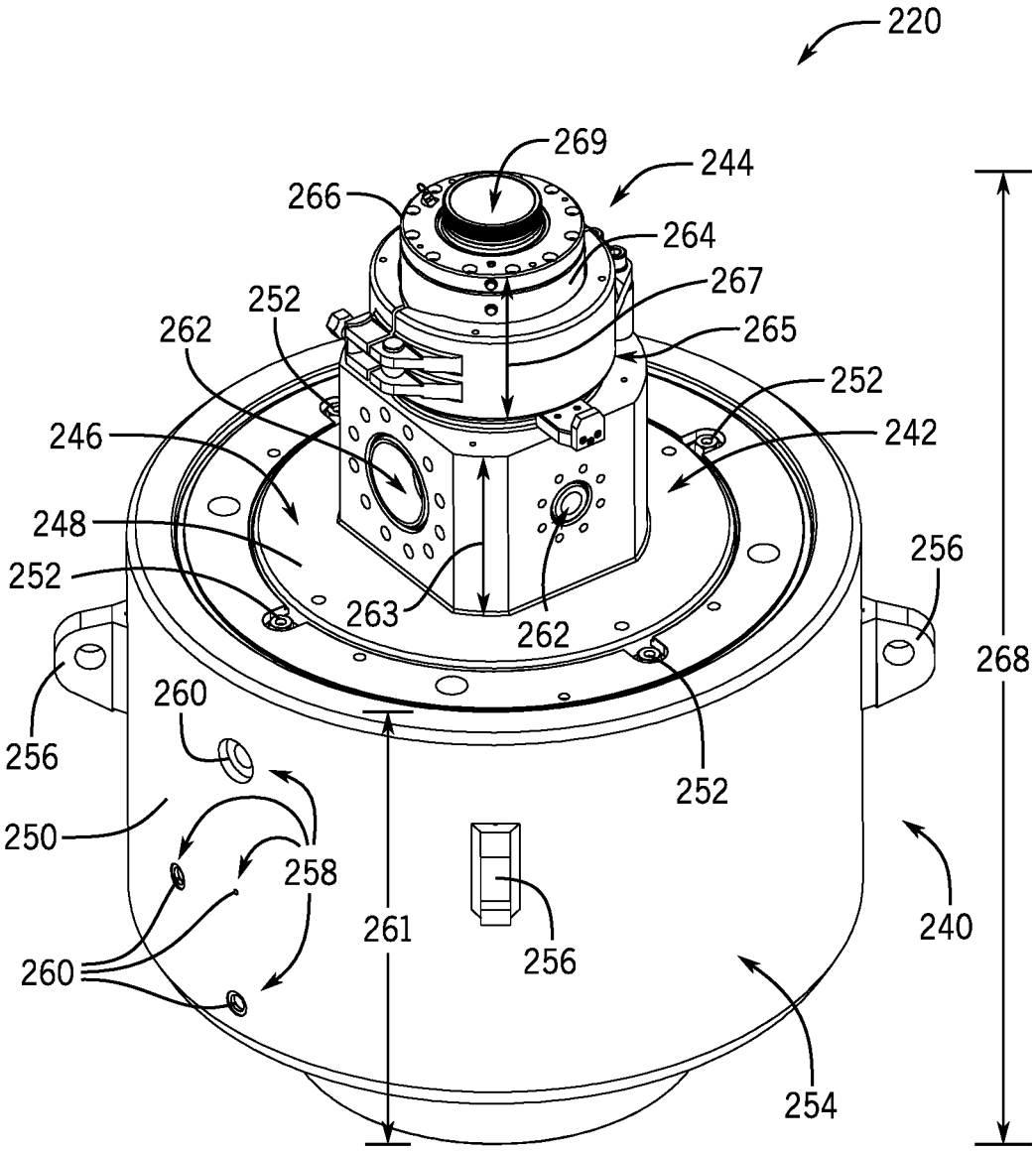
FIG. 11 is perspective view of an embodiment of the integrated assembly of FIG. 10, in accordance with an aspect of the present disclosure.

FIG. 11 is a perspective view of the integrated assembly 220. As shown in the illustrated embodiment of FIG. 11, the integrated assembly 220 includes an annular BOP portion 240, a diverter portion 242 (e.g., an annular diverter portion), and/or an RCU assembly portion 244 (e.g., an annular RCU assembly portion). It should be noted that in some embodiments, the diverter portion 242 and the RCU assembly portion 244 may be a single component of the integrated assembly 220 (e.g., the diverter portion 242 is a component of the RCU assembly 244). In certain embodiments, the annular BOP portion 240 may be positioned along the outer drill string 25 in a position closest to the wellhead 22 and furthest from the platform 16 (e.g., relative to the diverter portion 242 and the RCU assembly portion 244). Additionally, the RCU assembly portion 244 may be positioned furthest from the wellhead 22 and closest to the platform 16 (e.g., relative to the annular BOP portion 240 and the diverter portion 242). Further, the diverter portion 242 may be positioned in between the annular BOP portion 240 and the RCU assembly portion 244.

The annular BOP portion 240 may include a top surface 246 that is substantially sealed (e.g., fluid flowing through the outer drill string 25 does not leak through the BOP portion 240). As shown in the illustrated embodiment of FIG. 11, the top surface 246 may be formed from an integrated member 248 (e.g., a shared one-piece structure or body of the integrated assembly 220 common to the annular BOP portion 240, the diverter portion 242, and/or the RCU assembly portion 244) and a BOP body 250. In certain embodiments, the BOP body 250 may be a previously existing annular BOP body. Accordingly, the integrated member 248 may be incorporated into an existing BOP body of the mineral extraction system 10. The integrated member 248 may be disposed in the BOP body 250 and subsequently coupled to the BOP body 250 utilizing fasteners 252 (e.g., threaded fasteners such as bolts). In some embodiments, the fasteners 252 may be configured to establish a fluid-tight seal between the common member 248 and the BOP body 250. For example, the fasteners 252 may tighten an actuator ring, which may drive a lock ring disposed in a recess between the integrated member 248 and the BOP body 250 to form the seal. The actuator ring and the lock ring are discussed in more detail herein with reference to FIG. 12.

As shown in the illustrated embodiment of FIG. 11, the BOP body 250 may be cylindrically shaped with an outer surface 254 that includes transportation members 256 (e.g., hooks, loops, or lifting supports). For example, the BOP body 250 may be transported using a crane or other hoisting device that may utilize cables disposed in the transportation members 256 to support the BOP body 250 during assembly and/or transportation. Additionally, the outer surface 254 of the BOP body 250 may include one or more openings 258 configured to receive securement features 260. In some embodiments, the securement features 260 may extend through the BOP body 250 and into the integrated member 248, thereby further securing the integrated member 248 to the BOP body 250. The annular BOP portion 240 may include a height 261, which in some embodiments, may be defined by the BOP body 250 (e.g., a portion of the integrated member 248 that forms a part of the annular BOP portion 240 is completely disposed in the BOP body 250).

As shown in the illustrated embodiment, the integrated member 248 extends into the BOP body 250 (e.g., at least a portion of the integrated member 248 forms a portion of the annular BOP portion 240) and also forms at least a portion of the diverter portion 242. In some embodiments, the diverter portion 242 may include one or more openings 262 configured to direct drilling fluid flowing from the wellhead 22 away from the platform 16. For example, when operating under MPD conditions, it may be desirable to direct the drilling fluid to a pressure control system (e.g., a choke assembly) that enables accurate control of the drilling fluid pressure in the well 18. In some embodiments, the openings 262 of the diverter portion 242 may each include a different diameter, such that one of the openings 262 may be chosen based on operating parameters of the mineral extraction system 10. For example, a mineral extraction system 10 that utilizes high flow rates of drilling fluid may couple the drape hose 38 to an opening that includes a relatively large diameter. Conversely, a mineral extraction system 10 that utilizes low flow rates of drilling fluid may couple the drape hose 38 to an opening with a relatively small diameter. Additionally, the diverter portion 242 may include a height 263 (e.g., a first portion of the integrated member 248). As a result of the integrated member 248 forming at least a portion of the annular BOP portion and the diverter portion 242, the height 263 of the diverter portion 242 may be less than a height of a diverter when coupled to an annular BOP using a flange or other coupling device.

In some embodiments, the integrated member 248 may form an outer housing portion 265 of the RCU assembly portion 244, which may receive one or more additional components of the RCU assembly portion. Additionally, the integrated member 248 may include a lip (see, e.g., FIG. 12) that forms at least a portion of the RCU assembly portion 244. For example, the lip may be configured to couple the integrated member 248 to a rotation enabled portion 264 of the RCU assembly portion 244 via a clamp 266 and/or another fastening feature. Additionally, the rotation enabled portion 264 may be at least partially disposed in the outer housing portion 265. When the mineral extraction system 10 operates under MPD conditions, the rotation enabled portion 264 of the RCU assembly portion 244 may block the drilling fluid from flowing through the outer drill string 25 toward the platform 16, thereby directing substantially all of the drilling fluid (e.g., at least 90%) through the openings 262 of the diverter portion 242. Conversely, when the mineral extraction system 10 operates under traditional drilling conditions, a bearing assembly of the rotation enabled portion 264 (e.g., see FIG. 12) may be removed, thereby enabling the drilling fluid to flow through the outer drill string 25 toward the platform 16. The RCU assembly portion 244 may include a height 267 (e.g., a second portion of the integrated member 248). The height 267 may be less than a height of an RCU assembly when separately coupled to a diverter or another component using a flange or other coupling device. Accordingly, a height 268 of the integrated assembly 220 may be less than a combined height of a separate annular BOP, a diverter, and an RCU assembly coupled to one another because of the integrated member 248. The reduced height 268 may increase an amount of space available in the mineral extraction system 10, thereby enabling additional components to be included in the mineral extraction system 10.

Additionally, as shown in the illustrated embodiment of FIG. 11, the RCU assembly portion 244 may include an opening 269 configured to couple to the outer drill string 25, such that drilling fluid may flow toward the platform 16 when the mineral extraction system 10 operates using conventional drilling techniques. For example, the opening 269 may be fastened to the outer drill string 25 via a flange, a threaded fastener, and/or any other suitable securement feature that may form a fluid-tight seal between the RCU assembly portion 244 and the outer drill string 25. Similarly, the annular BOP portion 240 may also include an opening (not shown) configured to couple to the outer drill string 25.

Figure 12:
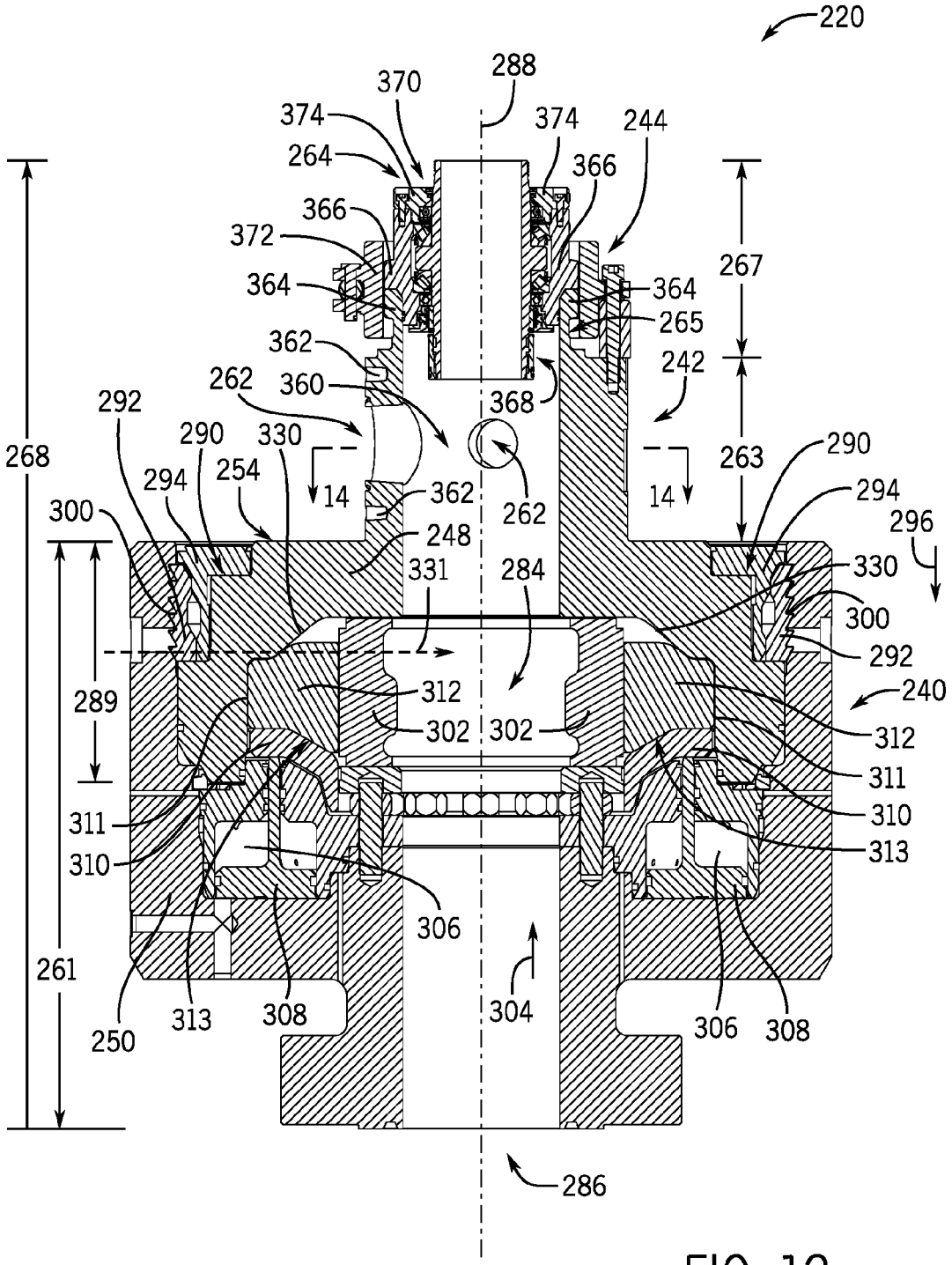
FIG. 12 is a sectional view of the integrated assembly of FIG. 11 when the annular blowout preventer is in a first position, in accordance with an aspect of the present disclosure.

FIG. 12 is a sectional view of the integrated assembly 220 when the annular BOP portion 240 is in a first position 284 (e.g., an open position). As shown in the illustrated embodiment of FIG. 12, the integrated assembly 220 is annular in that an opening 286 extends from the annular BOP portion 240 to the RCU assembly portion 244 along an axis 288. Accordingly, drilling fluid may flow from a first segment of the outer drill string 25, through the annular BOP portion 240, the diverter portion 242, and the RCU assembly portion 244, and to a second segment of the outer drill string 25 toward the platform 16. However, in some cases, the annular BOP portion 240 and/or the RCU assembly portion 244 may block and/or divert the drilling fluid from flowing between the first and second segments of the outer drill string 25. Additionally, the inner drill string 29 may extend through the integrated assembly 220 through the opening 286, such that drilling operations may be performed (e.g., the drill string may extend from the platform 16 to the well 18).

As shown in the illustrated embodiment of FIG. 12, the integrated member 248 is disposed in and coupled to the BOP body 250. The integrated member 248 may extend a distance 289 (e.g., a third portion of the integrated member 248) into the BOP body 250 from the outer surface 254. Additionally, because the integrated member 248 also forms the diverter portion 242, the overall height 268 of the integrated assembly 220 may be reduced because no coupling features are included. In certain embodiments, the distance 289 may be between 10% and 40%, between 15% and 35%, or between 20% and 30% of the overall height 268 of the integrated assembly 220. Additionally, or alternatively, the distance 289 may be between 30% and 60%, between 35% and 55%, or between 40% and 50% of the height 261 of the annular BOP portion 240. Moreover, because the integrated member 248 is a single piece shared between the annular BOP portion 240 and the diverter portion 242, no joints between the annular BOP portion 240 and the diverter portion 242 are included, thereby blocking the drilling fluid from leaking between the annular BOP portion 240 and the diverter portion 242.

In some embodiments, the integrated member 248 and the BOP body 250 may be coupled to one another to form a substantially fluid tight seal. For example, a recess 290 may be formed between the integrated member 248 and the BOP body 250. A lock ring 292 may be disposed in the recess 290 and an actuator ring 294 may be utilized to secure the lock ring 292 in the recess 290, thereby coupling the integrated member 248 and the BOP body 250. The actuator ring 294 may be driven in an axial direction 296 along the axis 288 into the recess 290 (e.g., via the fasteners 252), thereby directing the lock ring 292 radially outward toward the BOP body 250. The lock ring 292 may be configured to penetrate the BOP body 250 with teeth 300, such that the lock ring 292 may be secured to the BOP body 250. Further, pressure between the lock ring 292 and the actuator ring 294 may form a seal between the integrated member 248 and the BOP body 250. In some embodiments, coupling the integrated member 248 and the BOP body 250 with the lock ring 292 and the actuator ring 294 may form a substantially fluid-tight seal, which may block drilling fluid from exiting the integrated assembly 220 through the annular BOP portion 240.

As shown in the illustrated embodiment of FIG. 12, the annular BOP portion 240 includes movable components that may enable the annular BOP portion 240 to seal the outer drill string 25 in certain situations. For example, in some cases, the pressure in the well 18 may exceed a predetermined threshold such that it may be desirable to block a flow of drilling fluid flowing from the well 18 to avoid a surge of the drilling fluid toward the platform 16. Accordingly, to seal off the outer drill string 25, the annular BOP portion 240 may include a donut 302 configured to surround an outer surface of the inner drill string 29, such that drilling fluid flowing through the outer drill string 25 is blocked from moving in a second axial direction 304 toward the platform 16. In some embodiments, the donut 302 may be compressed radial inward toward the opening 286, such that the donut 302 may surround the inner drill string 29 and seal the outer drill string 25. The donut 302 may be biased toward the first position 284 (e.g., the open position), such that the drilling fluid may flow through the outer drill string 25 until the annular BOP portion 240 is engage to seal the outer drill string 25 (e.g., by compressing the donut 302).

For example, to seal the outer drill string 25, hydraulic fluid may be directed toward a hydraulic chamber 306 disposed in the annular BOP portion 240 (e.g., via a pump). As pressure builds within the hydraulic chamber 306, a piston 308 may be driven in the second axial direction 304 along the axis 288 by the hydraulic fluid. The piston 308 may drive a pusher plate 310 in the second axial direction 304 along an actuation guide surface 311, such that the pusher plate 310 may in turn compress a packer assembly 312. For example, the pusher plate 310 may include a tapered surface 313 (e.g., a linearly tapered surface), such that as the pusher plate 310 moves in the second axial direction 304, a force may be applied to the packer assembly 312 by the tapered surface 313 and surfaces of the integrated member 248 and/or the donut 302, which may cause the packer assembly 312 to compress. In some embodiments, the packer assembly 312 may include a resilient material (e.g., a polymeric material, an elastomeric material) that may compress when the force is applied (e.g., via movement of the pusher plate 310) and decompress when the force is removed. Further, the packer assembly 312 may be biased to a decompressed position 314, as shown in the illustrated embodiment of FIG. 12. When the packer assembly 312 is in the decompressed position 314, the donut 302 of the annular BOP portion 240 may be in the first position 284

(e.g., the open position), thereby enabling drilling fluid to flow through the opening 286 of the integrated assembly 220.

As shown in the illustrated embodiment of FIG. 12, the integrated member 248 includes a tapered surface 330 (e.g., a linearly tapered surface, an energizing linearly tapered surface, a cam surface, an annular BOP packer assembly activating surface) configured to facilitate compression of the packer assembly 312 when it is desired to seal the outer drill string 25. In certain embodiments, the tapered surface 330 may include an angle relative to a horizontal axis 331 between 10 degrees and 75 degrees, between 15 degrees and 60 degrees, or between 25 degrees and 50 degrees. Further, the tapered surface 330 may be substantially annular or conically shaped.

Figure 13:
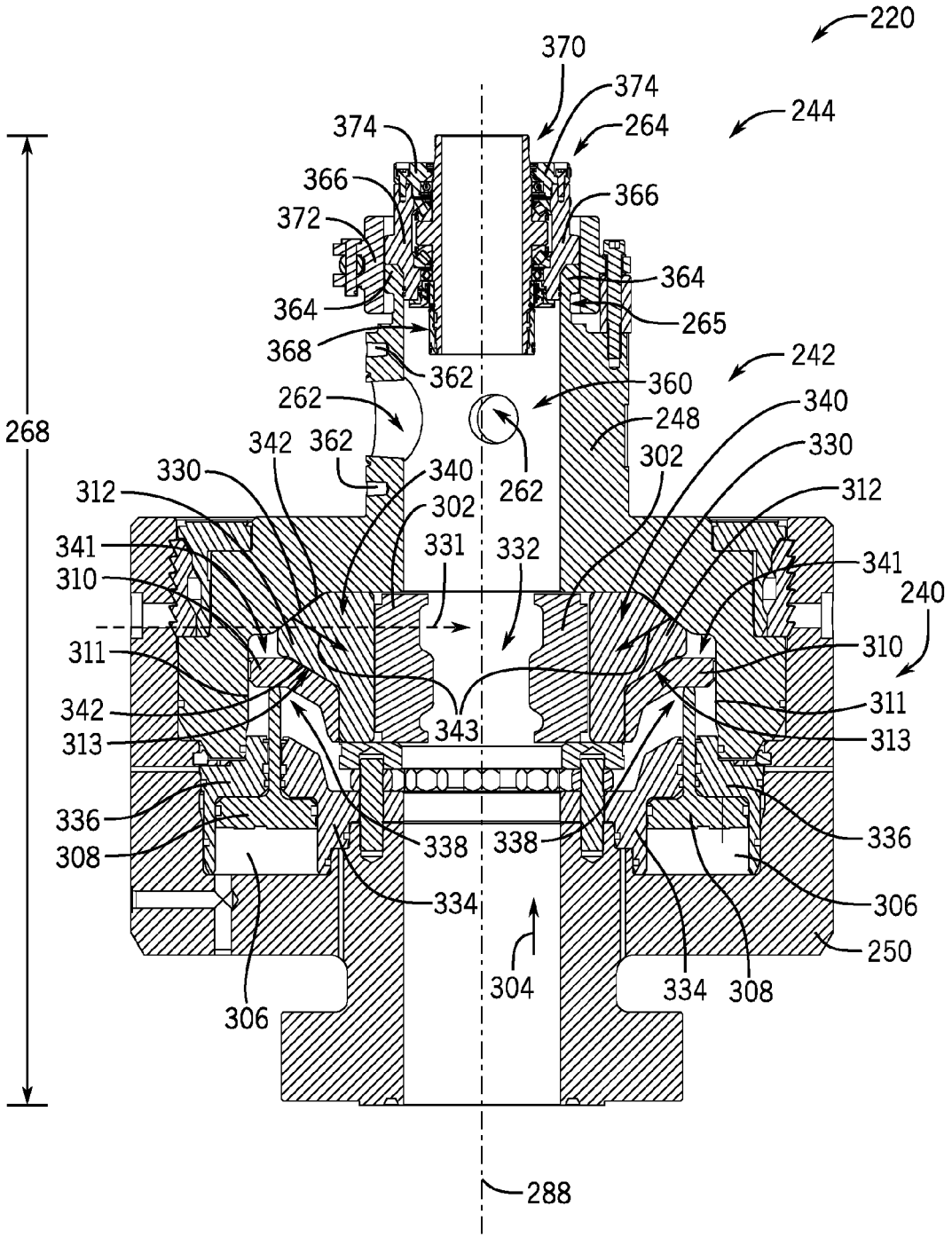
FIG. 13 is a sectional view of the integrated assembly of FIG. 11 when the annular blowout preventer is in a second position, in accordance with an aspect of the present disclosure.

FIG. 13 is a sectional view of the integrated assembly 220 where the annular BOP portion 240 is in a closed position 332 (e.g., a second position) and the donut 302 surrounds the inner drill string 29. As shown in the illustrated embodiment of FIG. 13, the piston 308 has been driven in the second axial direction 304 by the hydraulic fluid, such that the piston 308 contacts an inner cylinder 334 of the annular BOP portion 240 and an outer cylinder 336 of the annular BOP portion 240. Accordingly, the piston 308 also drives the pusher plate 310 into an activated position 338. As the pusher plate 310 moves toward the activated position, the tapered surface 313 of the pusher plate 310 and the tapered surface 330 of the integrated member squeeze (e.g., compress) the packer assembly 312 into a compressed position 340.

For example, movement of the piston 308 and the pusher plate 310 may reduce a volume of a chamber 341 for the packer assembly 312, where the chamber 341 is formed by the integrated member 248, the pusher plate 310, and the biasing donut 302. Because the integrated member 248 may be substantially stationary with respect to the BOP assembly portion 240, forces may be applied to the packer assembly 312 by tapered surface 313 of the pusher plate 310 and the tapered surface 330 of the integrated member 248 to form a tapered interfaces 342 between the tapered surfaces 313 and 330 and the packer assembly 312. The forces applied to the packer assembly 312 may cause the packer assembly 312 to compress, which may drive the donut 302 radially inward toward the inner drill string 29. In some embodiments, the tapered surface 330 of the integrated member 248 may facilitate compression of the packer assembly 312, and thus movement of the biasing donut 302 toward the closed position 332. For example, the forces applied to the packer assembly 312 by the tapered surface 330 may be in a direction 343 toward the biasing donut 302 (and thus the outer drill string 25) as a result of the slope defining the tapered surface 330.

As discussed above, the integrated member 248 may also form at least a portion of the diverter portion 242, as shown in the illustrated embodiment of FIGS. 12 and 13. For example, an annular segment 360 of the integrated member 248 may extend past the annular BOP assembly portion 240 to form at least a portion of the diverter portion 242. The annular segment 360 may include the openings 262 (e.g., diverter ports or outlets) that enable drilling fluid to be diverted from the outer drill string 25 and away from the platform 16. For example, the diverter portion 242 may include 2, 3, 4, 5, 6, 7, 8, 9, 10, or more openings 262 of equal or different sizes. In some embodiments, the openings 262 extend through the annular segment 360, thereby enabling the drilling fluid to flow along a predetermined path (e.g., during MPD operation). In some embodiments, the annular segment 360 may include one or more recesses 362 configured to receive corresponding fasteners that may couple a pipe or conduit over the openings 262. Accordingly, when drilling fluid is blocked from flowing through the RCU assembly portion 244, the drilling fluid may flow through the openings 262 and into the pipe or conduit toward a predetermined destination (e.g., a choke assembly at the platform configured to control a pressure of the drilling fluid).

Additionally, the integrated member 248 may form the outer housing 265 of the RCU assembly portion 244. The outer housing 265 of the RCU assembly portion 244 may include a lip 364 that may enable the integrated member 248 to be coupled to the rotation enabled portion 264. In some embodiments, the rotation enabled portion 264 may include a corresponding lip 366 that may be flush with the lip 364 of the integrated member 248 when positioned adjacent to one another (e.g., along the axis 288). As shown in the illustrated embodiments of FIGS. 12 and 13, a portion 368 of the rotation enabled portion 264 may extend into the outer housing 265 of the RCU assembly portion 244 and the corresponding lip 366 may block a second portion 370 of the rotation enabled portion 264 from being disposed in the outer housing 265 of the RCU assembly portion 244. Extension of the portion 368 into the outer housing 265 may further reduce the overall height 268 of the integrated assembly 220, thereby providing additional space in the mineral extraction system 10 for additional components. For example, the portion 368 may extend a distance into the outer housing 265 between 5% and 50%, between 10% and 40%, or between 15% and 35% of the height 267 of the RCU assembly portion 244.

In certain embodiments, the lip 364 of the integrated member 248 and the corresponding lip 366 of the rotation enabled portion 264 may be coupled to one another by a clamp 372. In other embodiments, one or more fasteners may be utilized to couple the lip 364 to the corresponding lip 366. In still further embodiments, another suitable coupling technique may be used to couple the lip 364 to the corresponding lip 366.

As discussed above, the rotation enabled portion 264 may block drilling fluid from flowing through the opening 286 toward the platform 16. Accordingly, the rotation enabled portion 264 may direct the drilling fluid to flow through the openings 262 of the diverter portion 242. For example, the rotation enabled portion 264 may include a bearing assembly 374, which may enable rotation of the rotation enabled portion 264 (e.g., during MPD operations). In certain embodiments, the bearing assembly 374 may be disposed at least partially into the outer housing 265 of the RCU assembly portion 244. The bearing assembly 374 may be configured to form a seal within the outer drill string 25 by utilizing pressure from the well 18. For example, as pressure builds in the well 18, the bearing assembly 374 may rotate, thereby causing the bearing assembly 374 to engage and seal the outer drill string 25 at the RCU assembly portion 244. When the bearing assembly 374 is engaged, drilling fluid may be blocked from flowing toward the platform 16 through the opening 286. The bearing assembly 374 may be included in the RCU assembly portion 244 when precise control of the drilling fluid pressure in the well 18 is desired (e.g., during MPD operations). However, in some cases, it may be desirable to remove the bearing assembly 374 (e.g., during conventional drilling). Accordingly, in the absence of the bearing assembly 374, drilling fluid may flow through the opening 286 toward the platform 16 regardless of the pressure in the well 18. In other words, no seal of the outer drill string 25 is formed at the RCU assembly portion 244 when the bearing assembly 374 is removed from the RCU assembly portion 244.

When the bearing assembly 374 is installed in the RCU assembly portion 244 of the integrated assembly 220 (e.g., during MPD operation), drilling fluid may be diverted through the openings 262. As shown in the illustrated embodiment of FIG. 14, the diverter portion 242 may include three of the openings 262, which may include a first diameter 390, a second diameter 392, and/or a third diameter 394. In some embodiments, the diameters 390, 392, and/or 394 may be between 0.5 inches and 12 inches, between 1 inch and 10 inches, or between 3 inches and 5 inches. It should be noted that while the diverter portion 242 of FIG. 14 includes three of the openings, the diverter portion 242 may include 1, 2, 4, 5, 6, 7, 8, 9, 10, or more of the openings 242. Including multiple openings 262 with varying diameters may enable the diverter portion 242 to accommodate different drilling operations performed using a variety of mineral extraction systems.

For example, in some cases a relatively high flow rate of drilling fluid may be directed into the well 18, and thus a relatively large diameter opening 262 may be desirable. Similarly, to maintain a reduced pressure in the well 18 a relatively large diameter opening 262 may be used to facilitate flow of the drilling fluid from the diverter portion 242. Additionally, in some cases, a relatively low flow rate of drilling fluid may be directed into the well 18, and thus a small diameter opening 262 may be desirable. In any case, including multiple openings 262 may enable the diverter portion 244 of the integrated assembly 220 to be installed in various mineral extraction systems without customizing the diverter portion 244 to a specific mineral extraction system.

Figure 15:
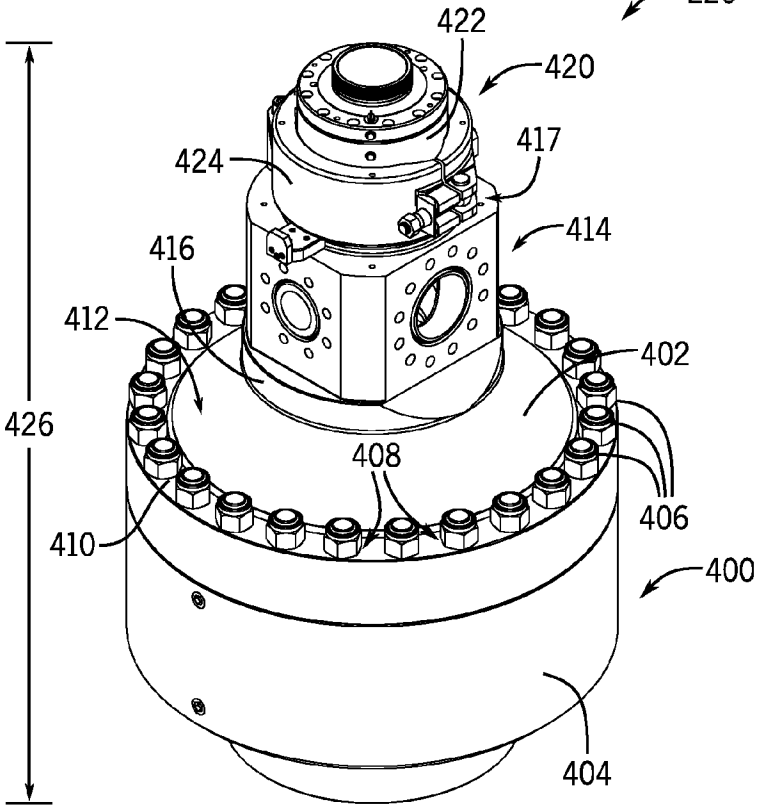
FIG. 15 is a perspective view of another embodiment of the integrated assembly of FIG. 10.
Figure 14:
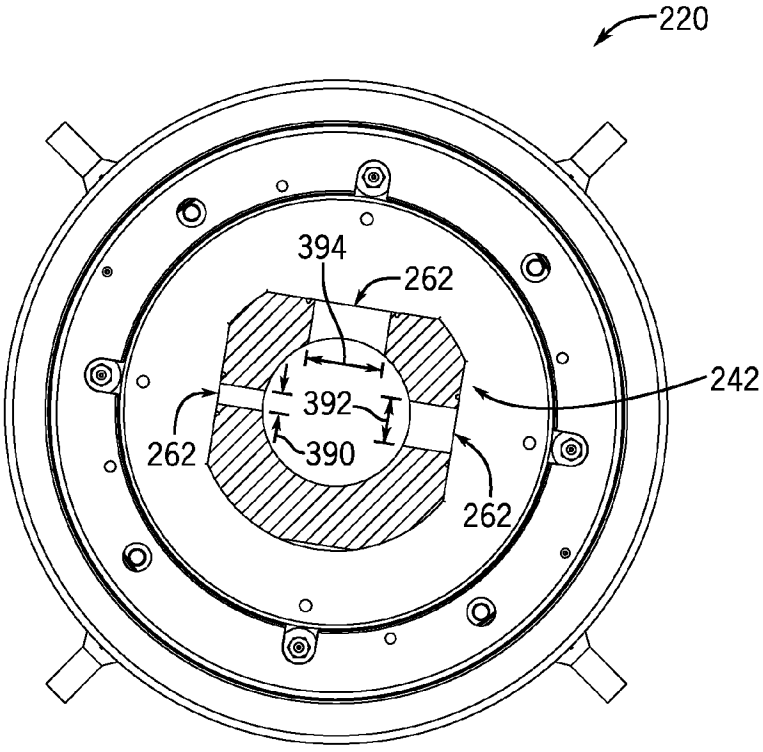
FIG. 14 is a sectional view of a diverter portion of the integrated assembly of FIG. 11 taken along line 14-14, in accordance with an aspect of the present disclosure.

Additionally, the annular BOP portion 240 of the integrated assembly 220 may be configured to be utilized with various types of annular BOPS. For example, FIG. 15 is a perspective view of the integrated assembly 220 that includes another embodiment of an annular BOP portion 400. As shown in the illustrated embodiment of FIG. 15, an integrated member 402 may be disposed in and coupled to a BOP body 404. For example, a plurality of fasteners 406 is disposed through openings 408 in an outer ring 410 of the integrated member 402 and may extend into the BOP body 404.

Additionally, the integrated member 402 may include a curved surface 412 extending from the outer ring 410 toward a diverter portion 414 of the integrated member 402. In some embodiments, the integrated member 402 may include a transition segment 416 between the curved surface 412 and a substantially box-shaped diverter portion 414. In other embodiments, the integrated member 402 may not include the transition segment 416.

The integrated member 402 may form an outer housing 417 of the RCU assembly portion 420, which may be configured to receive one or more additional components of the RCU assembly portion 420. Additionally, the outer housing 417 may include a lip 418 (see FIG. 16) that may be configured to couple to a rotation enabled portion 422 of the RCU assembly portion 420 via a clamp 424, as shown in the illustrated embodiment of FIG. 15. As discussed above, utilizing the integrating member 402 may reduce a height 426 and/or weight of the integrated assembly 220. For example, the integrated member 402 may eliminate flanged connections and/or other coupling mechanisms that may add height and/or weight when compared to the integrated assembly 220.

Figure 16:
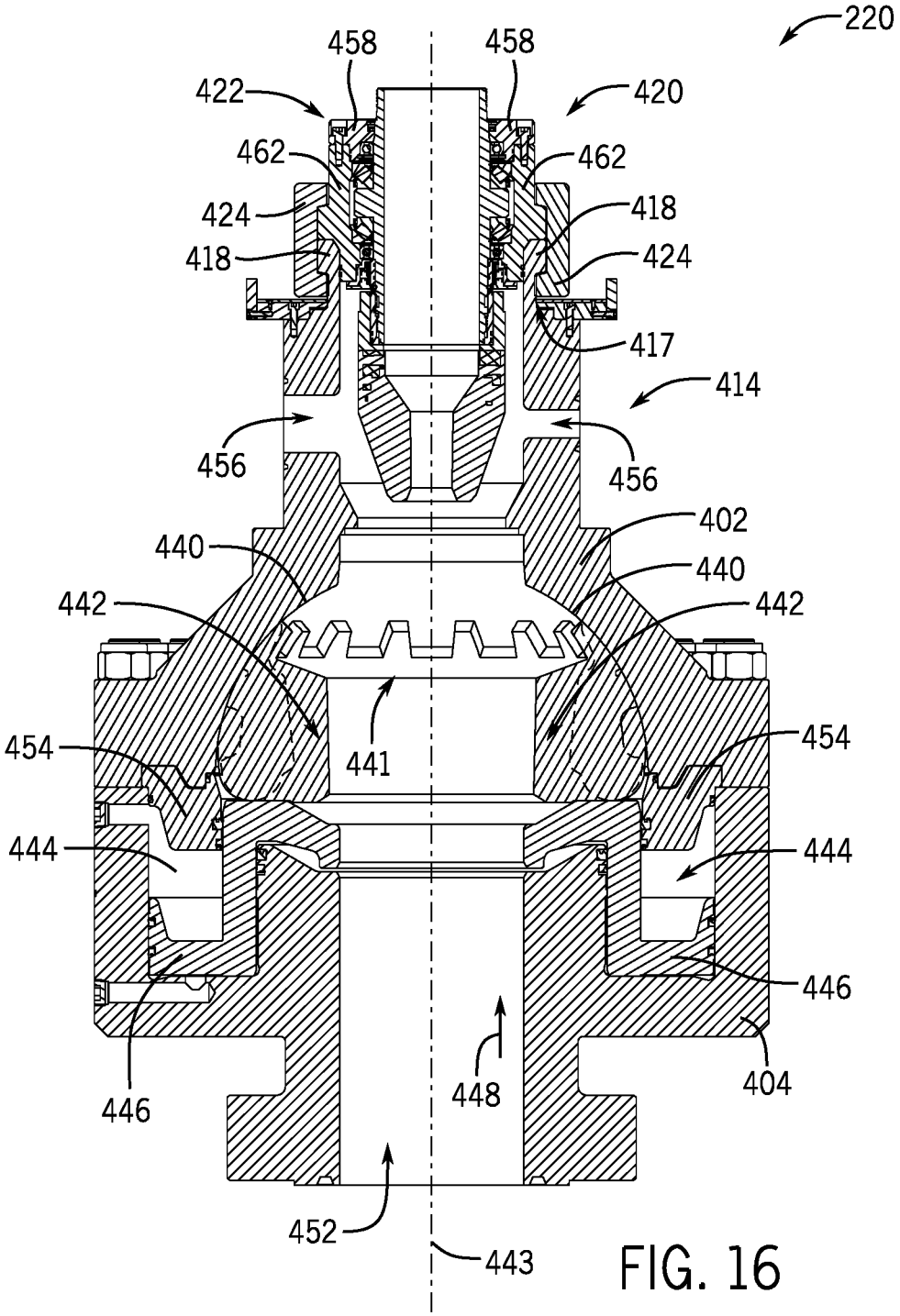
FIG. 16 is a sectional view of the integrated assembly of FIG. 11, in accordance with an aspect of the present disclosure.

In some embodiments, the configuration of the integrated member 402 may facilitate operation of the annular BOP portion 400. For example, FIG. 16 is a sectional view of the integrated assembly 220 of FIG. 15. As shown in the illustrated embodiment of FIG. 16, the integrated member 402 may include a tapered surface 440 (e.g., a curved tapered surface or a curved annular energizing surface) that may facilitate compression of a packing unit 442. In certain embodiments, the tapered surface 440 (e.g., a curved tapered surface) may include a gradually decreasing radius along a curved profile 441, which extends circumferentially about an axis 443.

For example, hydraulic fluid may enter a hydraulic chamber 444 formed between the integrated member 402 and the BOP body 404. As pressure builds in the hydraulic chamber 444, a piston 446 may be directed in an axial direction 448 (e.g., relative to an axis 443 defining an opening 452 through the integrated assembly 220) toward an adapter ring 454. As the piston 446 moves in the axial direction 448, the packing unit 442 may be driven in the axial direction 448 as the piston 446 applies a force to the packing unit 442. The packing unit 442 may contact the tapered surface 440 of the integrated member 402, which may apply a force to the packing unit 442 causing the packing unit 442 to compress radially inward. As the packing unit 442 compresses, it may cover, and thus block, the opening 452 through the integrated assembly 220. The curvature of the tapered surface 440 may facilitate compression of the packing unit 442 because the force applied by the tapered surface 440 may direct the packing unit 442 toward the opening 452.

Additionally, the integrated member 402 may form the diverter portion 414, which may divert drilling fluid through one or more openings 456 and block the drilling fluid from flowing through the opening 452 when the RCU assembly portion 420 includes a bearing assembly 458, which may be at least partially disposed in the outer housing 417 of the RCU assembly portion 420. Additionally, the integrated member 402 includes the lip 418 that may form at least a portion of the RCU assembly portion 420. The lip 418 may be disposed adjacent to a corresponding lip 462 of the rotation enabled portion 422 of the RCU assembly portion 420. The lip 418 and the corresponding lip 462 may then be coupled to one another by disposing the clamp 424 over the lip 460 and the corresponding lip 462. In other embodiments, the integrated member 402 may be coupled to the rotation enabled portion 422 of the RCU assembly portion 420 using another suitable technique.

As discussed above, the RCU assembly portion 420 may include the bearing assembly 456 that may block a flow of the drilling fluid through the opening 452 when installed in the RCU assembly portion 420. The drilling fluid may then be diverted through the openings 456 of the diverter portion 414 and away from the platform 16. However, in some cases (e.g., conventional drilling operations), it may not be desirable to include the bearing assembly 458, such that the drilling fluid may flow through the opening 452 toward the platform 16. Accordingly, installation of the bearing assembly 458 in RCU assembly portion 420 may be based on the desired operation of the mineral extraction system 10.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An integrated assembly for a mineral extraction system, comprising:

an annular blow out preventer (BOP) portion comprising a BOP body coupled to a first portion of a common body, wherein the annular BOP portion is configured to seal an outer drill string of the mineral extraction system, and wherein the first portion of the common body axially overlaps with the annular BOP portion;

a diverter portion formed at least partially by a second portion of the common body, wherein the diverter portion comprises one or more openings, and wherein the second portion of the common body axially overlaps with the diverter portion; and a rotating control unit (RCU) assembly portion comprising a third portion of the common body coupled to a rotation enabled portion, wherein the RCU assembly portion is configured to divert drilling fluid through the one or more openings of the diverter portion, wherein the third portion of the common body axially overlaps with the RCU assembly portion, and wherein the common body is shared between the first portion of the common body, the second portion of the common body, and the third portion of the common body.

2. The integrated assembly of claim 1, wherein the first portion of the common body, the second portion of the common body, and the third portion of the common body are integrated with one another to form the common body forged as one piece.

3. The integrated assembly of claim 1, wherein the first portion of the common body comprises a tapered surface configured to facilitate sealing the outer drill string of the mineral extraction system.

4. The integrated assembly of claim 3, wherein the tapered surface is configured to apply a force to a packing assembly of the annular BOP portion when a piston of the annular BOP portion moves in an axial direction relative to an axis defining an opening extending through the integrated assembly, and wherein the force enables the packing assembly to direct a donut of the annular BOP portion radially toward an inner drill string of the mineral extraction system.

5. The integrated assembly of claim 4, wherein the donut is configured to surround the inner drill string to seal the outer drill string, such that drilling fluid in the outer drill string is blocked from flowing toward a platform of the mineral extraction system.

6. The integrated assembly of claim 1, wherein the RCU assembly portion is configured to divert the drilling fluid through the one or more openings of the diverter portion when a bearing assembly is installed in the rotation enabled portion of the RCU assembly portion.

7. The integrated assembly of claim 6, wherein the bearing assembly is configured to seal the outer drill string and direct the drilling fluid through the one or more openings of the diverter portion.

8. The integrated assembly of claim 1, wherein the diverter portion comprises a plurality of openings, and wherein each opening of the plurality of openings comprises a different diameter.

9. The integrated assembly of claim 1, wherein the third portion of the common body comprises an outer housing of the RCU assembly portion configured to receive at least a portion of the rotation enabled portion of the RCU assembly portion.

10. The integrated assembly of claim 9, wherein the outer housing of the RCU assembly portion comprises a lip configured to couple to a corresponding lip of the rotation enabled portion with a clamp.

11. The system of claim 1, wherein the RCU assembly portion is disposed vertically above the annular BOP portion.

12. A drilling rig, comprising:

a platform;

a drill string configured to extend from the platform into a well;

an integrated assembly disposed along the drill string, wherein the integrated assembly comprises;

an annular blow out preventer (BOP) portion comprising a BOP body coupled to a first portion of a common body, wherein the annular BOP portion is configured to seal the drill string when a pressure in the well exceeds a threshold, and wherein the first portion of the common body axially overlaps with the annular BOP portion;

a diverter portion formed at least partially by a second portion of the common body, wherein the diverter portion comprises one or more openings, and wherein the second portion of the common body axially overlaps with the diverter portion; and a rotating control unit (RCU) assembly portion comprising a third portion of the common body coupled to a rotation enabled portion, wherein the RCU assembly portion is configured to divert drilling fluid flowing in the drill string toward the platform through the one or more openings of the diverter portion, wherein the third portion of the common body axially overlaps with the RCU assembly portion, and wherein the common body is shared between the first portion of the common body, the second portion of the common body, and the third portion of the common body.

13. The drilling rig of claim 12, wherein the first portion of the common body comprises a tapered surface configured to facilitate sealing the drill string.

14. The drilling rig of claim 13, wherein the tapered surface is configured to apply a force to a packing unit of the annular BOP portion when a piston of the annular BOP portion moves in an axial direction relative to an axis defining an opening extending through the integrated assembly, and wherein the force directs the packing unit toward an inner drill string extending from the platform into the well.

15. The drilling rig of claim 14, wherein the packing unit is configured to surround the inner drill string to seal the drill string, such that drilling fluid in the drill string is blocked from flowing toward the platform.

16. The drilling rig of claim 12, wherein the first portion of the common body, the second portion of the common body, and the third portion of the common body are integrated with one another to form the common body forged as one piece.

17. A system, comprising:

an annular blow out preventer (BOP) portion comprising a BOP body coupled to a first portion of a common body, wherein the annular BOP portion is configured to seal an outer drill string of the mineral extraction system, wherein the first portion of the common body comprises a tapered surface configured to facilitate sealing the outer drill string, and wherein the first portion of the common body axially overlaps with the annular BOP portion;

a diverter portion formed at least partially by a second portion of the common body, wherein the diverter portion comprises one or more openings, and wherein the second portion of the common body axially overlaps with the diverter portion; and a rotating control unit (RCU) assembly portion comprising a third portion of the common body coupled to a rotation enabled portion, wherein the RCU assembly portion comprises a removable bearing assembly configured to divert drilling fluid through the one or more openings of the diverter portion, wherein the third portion of the common body axially overlaps with the RCU assembly portion, and wherein the common body is shared between the first portion of the common body, the second portion of the common body, and the third portion of the common body.

18. The system of claim 17, wherein the first portion of the common body, the second portion of the common body, and the third portion of the common body are integrated with one another to form the common body forged as one piece.

19. The system of claim 17, wherein a flanged connection is absent at least between the annular BOP portion and the diverter portion.

20. The system of claim 17, wherein the drilling fluid is configured to flow through an opening extending through the annular BOP portion, the diverter portion, and the rotating control unit portion toward a platform of a drilling rig when the removable bearing assembly is removed from the RCU assembly portion.

21. The system of claim 17, wherein the tapered surface is configured to apply a force to a packing assembly of the annular BOP portion when a piston of the annular BOP portion moves in an axial direction relative to an axis defining an opening extending through the annular BOP portion, the diverter portion, and the RCU assembly portion, and wherein the force enables the packing assembly to direct a donut of the annular BOP portion radially toward an inner drill string of a mineral extraction system to seal the outer drill string.

* * * * *